US010000078B2

(12) United States Patent
Ishikawa et al.

(10) Patent No.: US 10,000,078 B2
(45) Date of Patent: Jun. 19, 2018

(54) PRINTER APPARATUS

(71) Applicant: FUJITSU COMPONENT LIMITED, Tokyo (JP)

(72) Inventors: Tetsuhiro Ishikawa, Tokyo (JP); Sumio Watanabe, Tokyo (JP); Yukihiro Mori, Tokyo (JP); Masahiro Tsuchiya, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days. days.

(21) Appl. No.: 15/500,978

(22) PCT Filed: Aug. 19, 2015

(86) PCT No.: PCT/JP2015/073204

§ 371 (c)(1),
(2) Date: Feb. 1, 2017

(87) PCT Pub. No.: WO2016/027824

PCT Pub. Date: Feb. 25, 2016

(65) Prior Publication Data

US 2017/0217223 A1 Aug. 3, 2017

(30) Foreign Application Priority Data

Aug. 20, 2014 (JP) ..... 2014-167894

(51) Int. Cl.

| | |
|---|---|
| ***B41J 2/32*** | (2006.01) |
| ***B41J 11/70*** | (2006.01) |
| ***B41J 15/00*** | (2006.01) |

(52) U.S. Cl.

CPC ..... *B41J 11/70* (2013.01); *B41J 2/32* (2013.01); *B41J 15/005* (2013.01)

(58) Field of Classification Search

CPC ..... B41J 2/32; B41J 11/00; B41J 11/66; B41J 11/70; B41J 15/00; B41J 15/005;

(Continued)

(56) References Cited

U.S. PATENT DOCUMENTS 5,588,762 A * 12/1996 Suzuki ..... B41J 15/005 400/582
5,649,776 A * 7/1997 Sugimoto ..... B41J 15/005 400/617

(Continued)

FOREIGN PATENT DOCUMENTS

| | | |
|---|---|---|
| JP | 2003-019845 | 1/2003 |
| JP | 2014-091585 | 5/2014 |

*Primary Examiner* — Anh T. N. Vo
(74) *Attorney, Agent, or Firm* — IPUSA, PLLC

(57) ABSTRACT

A printer apparatus includes a printer main body having a platen roller and a print head to print on recording paper, a cutter unit configured to cut the recording paper, and a presenter unit connected to the cutter unit, wherein the recording paper on which the print head has printed enters the presenter unit through the cutter unit, and comes out from a discharge slot of the presenter unit, wherein the presenter unit includes a first roller and a second roller configured to convey the recording paper placed therebetween, and a flapper disposed along a transportation path of the recording paper between the cutter unit and both the first roller and the second roller, and configured to be flipped open to an outside of the presenter unit to expose the transportation path, wherein an angle at which the flapper is open is selectively set to one of a plurality of different angles.

7 Claims, 20 Drawing Sheets

(58) Field of Classification Search
CPC ... B41J 15/24; B41J 17/02; B41J 29/13; B41J 29/38
See application file for complete search history.

(56) References Cited

U.S. PATENT DOCUMENTS

| | | | | |
|---|---|---|---|---|
| 6,428,226 | B1 * | 8/2002 | Suzuki | B41J 13/106 400/642 |
| 6,814,515 | B2 | 11/2004 | Tsuchiya et al. | |
| 6,889,031 | B2 * | 5/2005 | Tsuchida | G03G 15/234 271/227 |
| 6,960,259 | B2 * | 11/2005 | Takekoshi | B05C 1/0813 118/217 |
| 2014/0119805 | A1 | 5/2014 | Oguchi et al. | |

* cited by examiner

PRINTER APPARATUS

TECHNICAL FIELD

The disclosures herein relate to a printer apparatus.

BACKGROUND ART

Printers for producing sales receipts or the like are widely used in cash registers used in stores, ATMs (automatic teller machines) or CDs (cash dispensers) installed in banks, etc. In a printer for producing sales receipts or the like, a print head prints on thermal paper serving as recording paper while the recording paper is advanced. After the recording paper is advanced a predetermined length, a predetermined length of the recording paper is cut from the rest of the paper. A cutter has a fixed blade and a movable blade. The movable blade is moved toward the fixed blade to cut recording paper that is placed between the fixed blade and the movable blade. Such a printer may be provided with a presenter connected thereto for the purpose of allowing a printed recording sheet to be removed.

RELATED-ART DOCUMENTS

Patent Document

[Patent Document 1] Japanese Patent Application Publication No. 2003-19845

SUMMARY OF THE INVENTION

Problem to be Solved by the Invention

In the case of printed recording sheets having respective different usages or the like, the printer apparatus is required to be capable of sorting and storing the recording sheets according to their usages or the like. Such printer apparatuses capable of sorting and storing printed recording sheets are mostly bulky. Accordingly, there is a need for a small-sized, low-cost printer apparatus capable of sorting and storing printed recording sheets.

Means to Solve the Problem

According to one aspect of a present embodiment, a printer apparatus includes a printer main body having a platen roller and a print head to print on recording paper, a cutter unit configured to cut the recording paper, and a presenter unit connected to the cutter unit, wherein the recording paper on which the print head has printed enters the presenter unit through the cutter unit, and comes out from a discharge slot of the presenter unit, wherein the presenter unit includes a first roller and a second roller configured to convey the recording paper placed therebetween, and a flapper disposed along a transportation path of the recording paper between the cutter unit and both the first roller and the second roller, and configured to be flipped open to an outside of the presenter unit to expose the transportation path, wherein an angle at which the flapper is open is selectively set to one of a plurality of different angles.

Advantage of the Invention

According to at least one embodiment, a small-sized, low-cost printer apparatus capable of sorting and storing printed recording sheets is provided.

MODE FOR CARRYING OUT THE INVENTION

Figure 1:
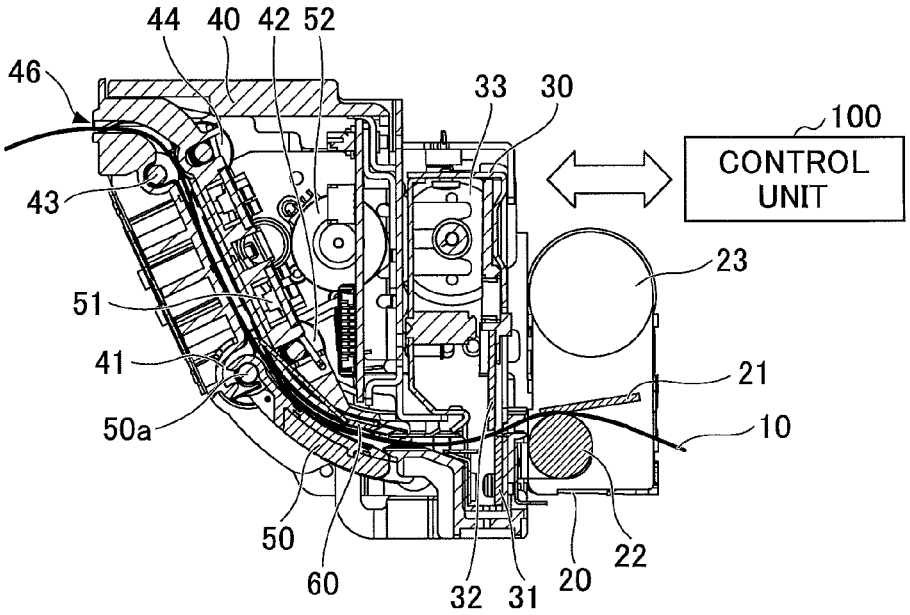
FIG. 1 is a drawing illustrating the structure of a printer apparatus according to a present embodiment.
Figure 2:
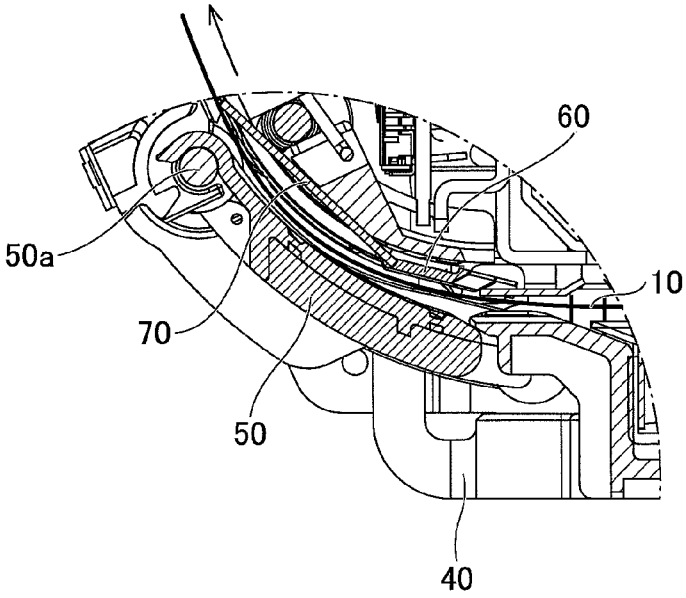
FIG. 2 is an enlarged view of a main part of the printer apparatus according to the present embodiment.
Figure 3:
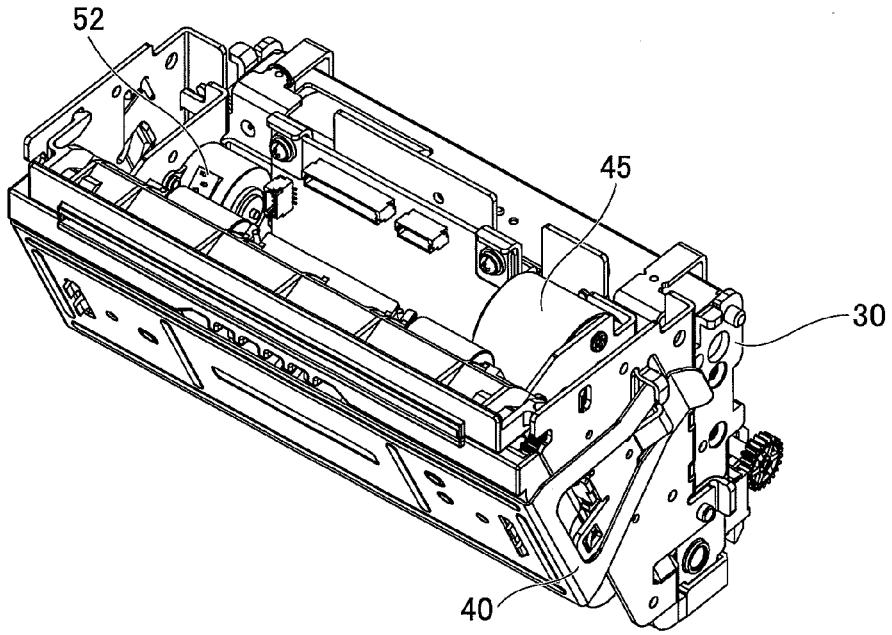
FIG. 3 is an axonometric view of the printer apparatus according to the present embodiment.
Figure 4:
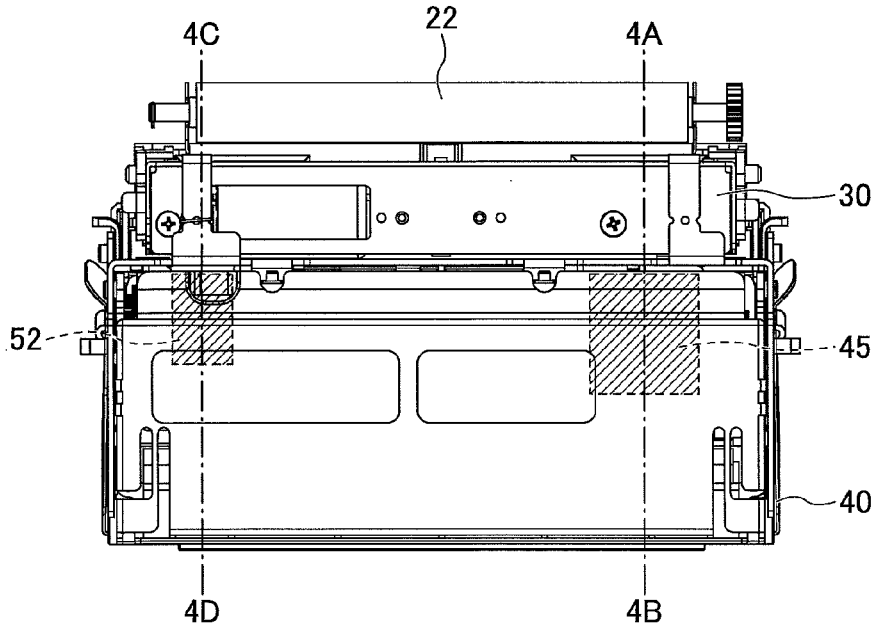
FIG. 4 is a top view of the printer apparatus according to the present embodiment.
Figure 5:
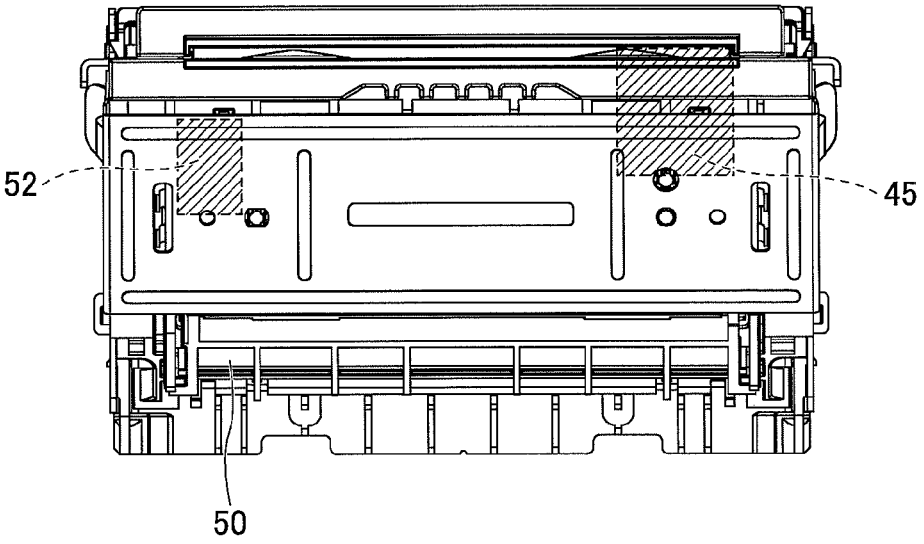
FIG. 5 is a front view of the printer apparatus according to the present embodiment.
Figure 6:
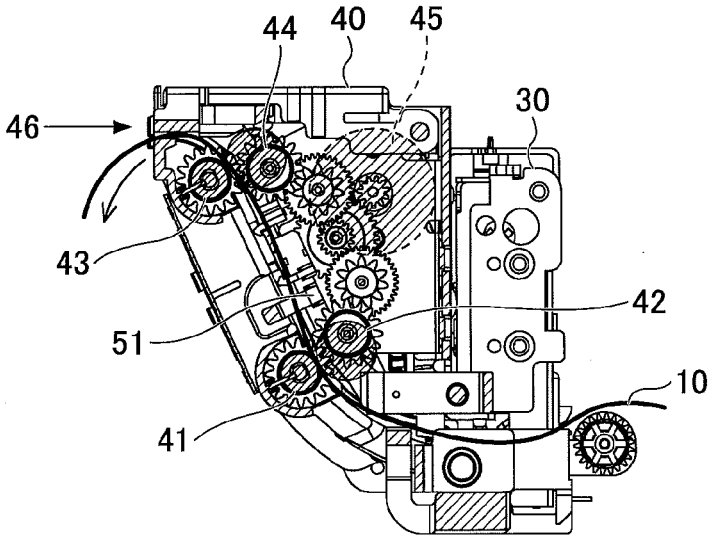
FIG. 6 is a cross-sectional view (1) of the printer apparatus according to the present embodiment.
Figure 7:
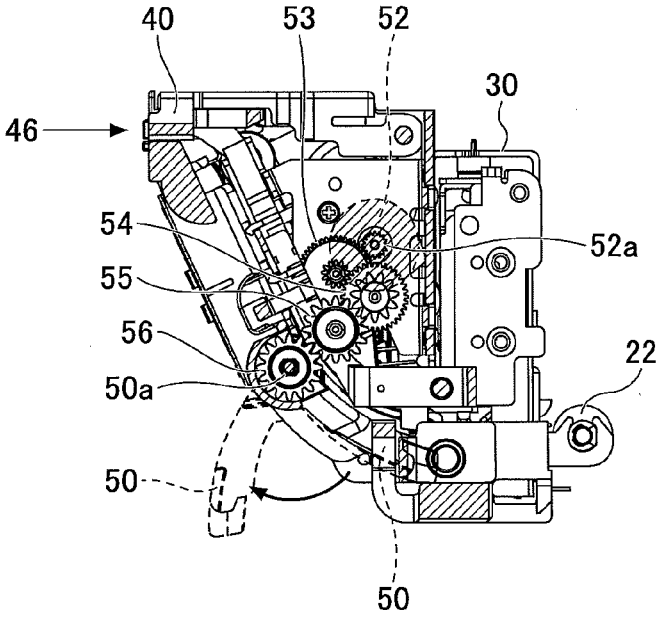
FIG. 7 is a cross-sectional view (2) of the printer apparatus according to the present embodiment.

In the following, embodiments for implementing the invention will be described. The same members or the like are referred to by the same numerals, and a description thereof will be omitted A printer apparatus according to the present embodiment will be described with reference to FIG. 1 through FIG. 7. FIG. 1 is a schematic view illustrating the structure of the printer apparatus according to the present embodiment. FIG. 2 is an enlarged view of a main portion of the printer apparatus illustrated in FIG. 1. FIG. 3 is an axonometric view of the printer apparatus. FIG. 4 is a top view of the printer apparatus. FIG. 5 is a front view of the printer apparatus. FIG. 6 is a cross-sectional view of the printer apparatus taken along the doted and dashed line 4A-4B in FIG. 4. FIG. 7 is a cross-sectional view of the printer apparatus taken along the doted and dashed line 4C-4D in FIG. 4. FIG. 1, FIG. 2, and FIG. 6 illustrate recording paper 10 for the purpose of providing a clear view of a transport path of the recording paper.

The printer apparatus of the present embodiment prints on the recording paper 10 from a paper roll. The printer apparatus includes a printer main body 20, a cutter unit 30, and a presenter unit 40. In the present embodiment, the printer main body 20 and the cutter unit 30 are connected to each other, and the cutter unit 30 and the presenter unit 40 are connected to each other.

In general, the presenter unit 40 receives the recording paper 10 printed by a thermal head 21 through the cutter unit 30. The recording paper 10 cut at a predetermined length by the cutter unit 30 is partially exposed from a discharge slot 46 such that the user can remove the exposed sheet from the presenter unit 40. Upon the recording paper 10 in this state being removed by the user, the print operation by the printer apparatus comes to completion. If a predetermined time length passes in this state without the recording paper 10 being removed by the user, a retract operation is performed such that the printed recording sheet 10 is retracted into the presenter unit 40. The printer apparatus of the present embodiment is provided with the function to sort and store the printed recording paper 10 in the presenter unit 40.

The printer main body 20 includes a thermal head 21 serving as a print head for printing on the recording paper 10, a platen roller 22, and a transport motor 23 for conveying the recording paper 10. The recording paper 10 is fed into the printer main body 20 through a transport slot that is not illustrated. The cutter unit 30 includes a fixed blade 31, a movable blade 32, a movable-blade motor 33 for driving the movable blade 32, and gears and the like (not shown) for transmitting the driving force generated by the rotation of the movable-blade motor 33 to the movable blade 32.

In the printer main body 20, the transport motor 23 rotates the platen, roller 22 while the recording paper 10 is placed between the thermal head 21 and the platen roller 22, thereby conveying the recording paper 10. The thermal head 21 prints on the recording paper 10 being conveyed by the rotation of the platen roller 22.

The printed recording paper 10 is then cut by the cutter unit 30. Specifically, upon the recording paper 10 being moved to a predetermined location, the movable-blade motor 33 rotates to drive the movable blade 32 and to move the movable blade 32 toward the fixed blade 31, thereby cutting the recording paper 10 between the fixed blade 31 and the movable blade 32.

The presenter unit 40 includes a first roller 41, a second roller 42, a third roller 43, a fourth roller 44, a transport motor 45, a flapper 50, and a recording paper transport guide 60, which are provided for the purpose of conveying printed recording paper. The first roller 41 and the second roller 42 are disposed to face each other, and the third roller 43 and the fourth roller 44 are disposed to face each other. The first roller 41 and the third roller 43 are rotated by the rotation of the transport motor 45 through the operation of gears (not shown). The second roller 42 in contact with the first roller 41 rotates in conjunction with the rotation of the first roller 41, and the fourth roller 44 in contact with the third roller 43 rotates in conjunction with the rotation of the third roller 43. With this arrangement, the recording paper 10 placed between the first roller 41 and the second roller 42 and placed between the third roller 43 and the fourth roller 44 is conveyed inside the presenter unit 40.

The length of the recording paper 10 upon being cut is dependent on the usage thereof or the like, so that the position at which the recording paper 10 is cut also varies. Since the length of the transport path of the recording paper 10 inside the presenter unit 40 is a fixed length, the recording paper 10 needs to be cut after creating a slack in the recording paper 10 in the presenter unit 40 in the case in which a longer length of the recording paper 10 than the length of the transport path needs to be cut. In the present embodiment, as illustrated by dotted lines in FIG. 7, the flapper 50 of the presenter unit 40 is flipped open to the outside of the presenter unit 40 in the direction illustrated by an arrow, thereby providing a slack in the printed recording paper 10 extending to the outside of the presenter unit 40. With this arrangement, the recording paper 10 can be cut to have a desired length even if the length of the recording paper 10 to be discharged is longer than the entire length of the transport path inside the presenter unit 40.

The flapper 50 is connected to the presenter unit 40 such as to be rotatable around a rotation axis 50*a*. A flapper drive motor 52 disposed inside the presenter unit 40 rotates to flip open and close the flapper 50. Specifically, a first gear 53, a second gear 54, a third gear 55, and a fourth gear 56 are provided in the presenter unit 40. The first gear 53 is connected to a gear 52*a* of the flapper drive motor 52. Accordingly, rotation of the flapper drive motor 52 causes the gear 52*a* of the flapper drive motor 52, the first gear 53, the second gear 54, the third gear 55, and the fourth gear 56 to rotate, thereby causing the flapper 50 to rotate around the rotation axis 50*a* to flip open.

In the printer apparatus of the present embodiment, as illustrated in FIG. 2, for example, the recording paper transport guide 60 is provided in the presenter unit 40. The recording paper transport guide 60, which is situated further toward the inside than the flapper 50 in the presenter unit 40, is supported by the flapper 50 when the flapper 50 is in the closed position. The recording paper transport guide 60 is disposed to face the flapper 50 across the transport path of the recording paper 10. Namely, the recording paper transport guide 60 is situated further toward the inside than the transport path of the recording paper 10, and the flapper 50 is situated further toward the outside than the transport path of the recording paper 10. The support by the flapper 50 is removed as the flapper 50 opens, resulting in the recording paper transport guide 60 being also flipped outward (i.e., moving toward the outside). When the flapper 50 is closed and the recording paper 10 is situated between the flapper 50 and the recording paper transport guide 60, the recording paper transport guide 60 is supported by the flapper 50 via the recording paper 10.

In the present embodiment, a recording paper sensor 51 is provided between the first roller 41 and the third roller 43 in order to detect whether the recording paper 10 is present in the transport path between the first roller 41 and the third roller 43.

The recording paper transport guide 60 may be flipped to the outside due to its own weight. Alternatively, a member exerting a restorative force such as a spring may be provided, and the recording paper transport guide 60 may be flipped to the outside by the restorative force of the spring or the like.

Figure 8:
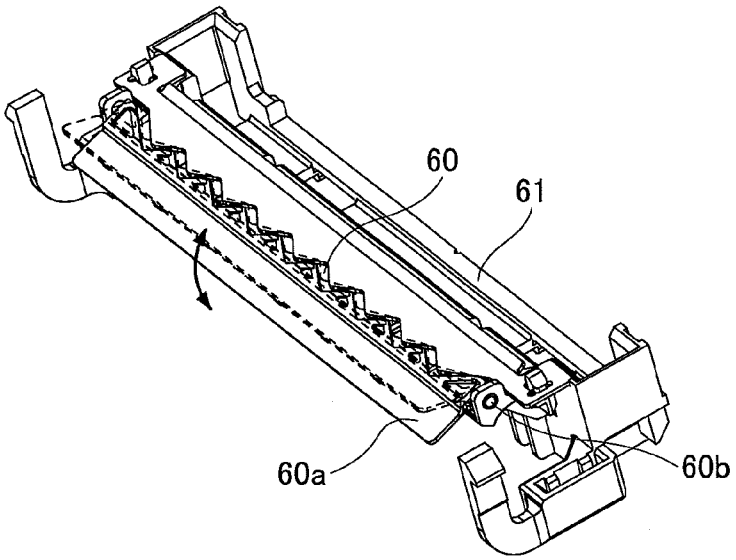
FIG. 8 is an axonometric view of a recording paper transport guide of the printer apparatus according to the present embodiment.

As illustrated in FIG. 8, the recording paper transport guide 60 is connected in a rotatable manner to a mount member 61, which is provided to attach the recording paper transport guide 60 to the presenter unit 40. Specifically, the recording paper transport guide 60 has a guide unit 60*a* for guiding the recording paper 10, and rotates around a rotation axis 60*b* provided for the recording paper transport guide 60 so as to change the direction of the guide unit 60*a*. With this arrangement, the downward movement of the guide unit 60*a* causes the recording paper transport guide 60 in FIG. 2 to flip outward (i.e., moves toward the outside) to intrude into the transport path, thereby being able to change the transport direction of the recording paper 10 toward the outside of the presenter unit 40.

Figure 9A:
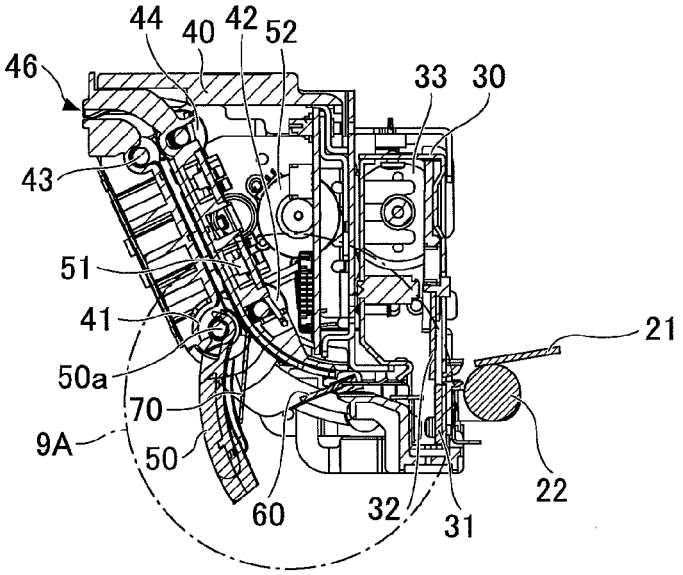
FIG. 9A is a drawing illustrating the printer apparatus of the present embodiment.
Figure 9B:
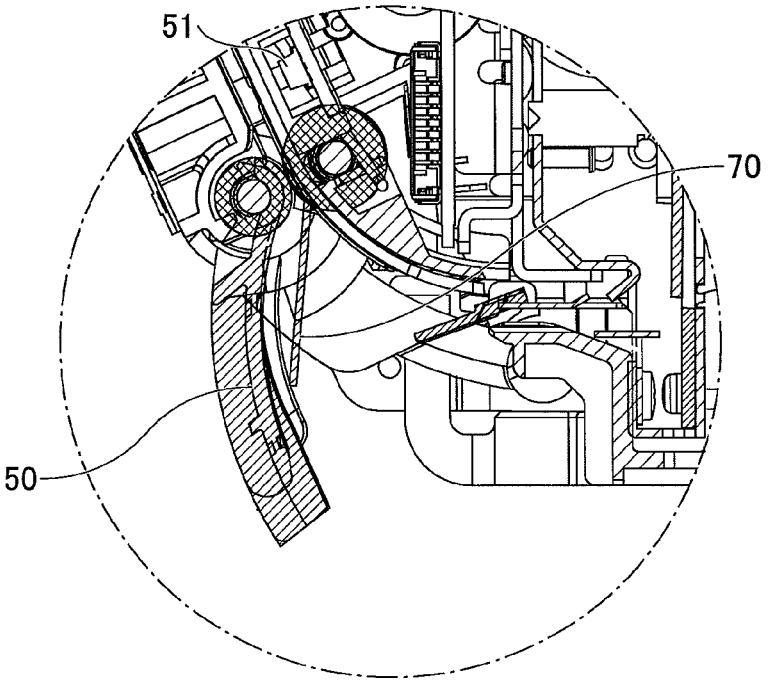
FIG. 9B is a drawing illustrating the printer apparatus of the present embodiment.

In the present embodiment, a recording paper guiding member 70 is provided that operates in conjunction with the flapper 50 when the flapper 50 is flipped open as illustrated in FIGS. 9A and 9B. The recording paper guiding member 70 is installed in the presenter unit 40. The printed recording paper 10 is conveyed by passing between the flapper 50 and the recording paper guiding member 70. Namely, when the flapper 50 is closed in the present embodiment, the printed recording paper 10 passes through the transport path between the recording paper guiding member 70 and the flapper 50 in the closed position. The recording paper guiding member 70 is disposed on the opposite side to the flapper 50 across the printed recording paper 10. Accordingly, when the flapper 50 is in the open position, the printed recording paper 10 passes between the flapper 50 and the recording paper guiding member 70 to be conveyed to one of the plurality of collection boxes, as will be described later. FIG. 9B is an enlarged view of a portion enclosed by a dotted and dashed line 9A in FIG. 9A.

Figure 10:
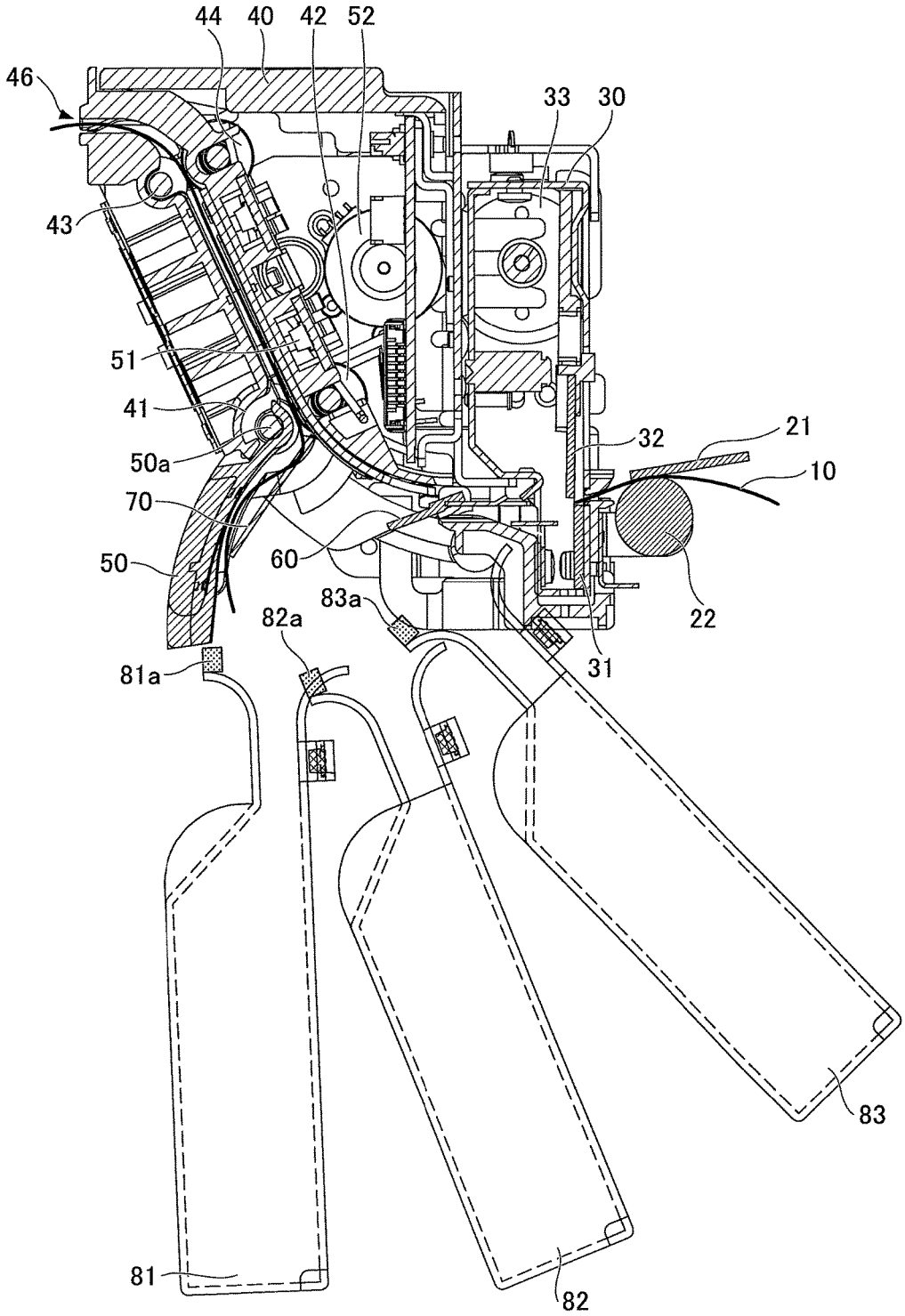
FIG. 10 is a drawing illustrating the structure of collection boxes of the printer apparatus according to the present embodiment.

In the present embodiment, a plurality of collection boxes for sorting and storing the printed recording paper 10, i.e., a first collection box 81, a second collection box 82, and a third collection box 83, are provided as illustrated in FIGS. 10A and 10B. In the case of collecting the recording paper 10, the printed recording paper 10 upon being cut by the cutter unit 30 passes between the flapper 50 and the recording paper guiding member 70 to be stored in one of the first collection box 81, the second collection box 82, and the third collection box 83. Each of the collection boxes has a sensor for detecting the position of the flapper 50. The sensor may be a reflective optical sensor. The first collection box 81 is provided with a first collection-position detecting sensor 81*a*. The second collection box 82 is provided with a second collection-position detecting sensor 82*a*. The third collection box 83 is provided with a third collection-position detecting sensor 83*a*. These collection-position detecting sensors 81*a* through 83*a* detect the position of the flapper 50. The operation of the flapper drive motor 52 is then controlled in response to the resultant detected position, so that the open angle of the flapper 50 is adjusted to orient the flapper 50 to the position of the desired collection box.

In the present embodiment, the angle at which the flapper 50 opens is changed to store the recording paper 10 to be collected in the desired collection box, i.e., one of the first collection box 81, the second collection box 82, and the third collection box 83. In order to store the recording paper 10 in the desired collection box, the transport motor 45 is rotated in the reverse direction to convey the recording paper 10 through the transport path of the presenter unit 40 in the opposite direction, i.e., in the direction toward the collection box.

Figure 11:
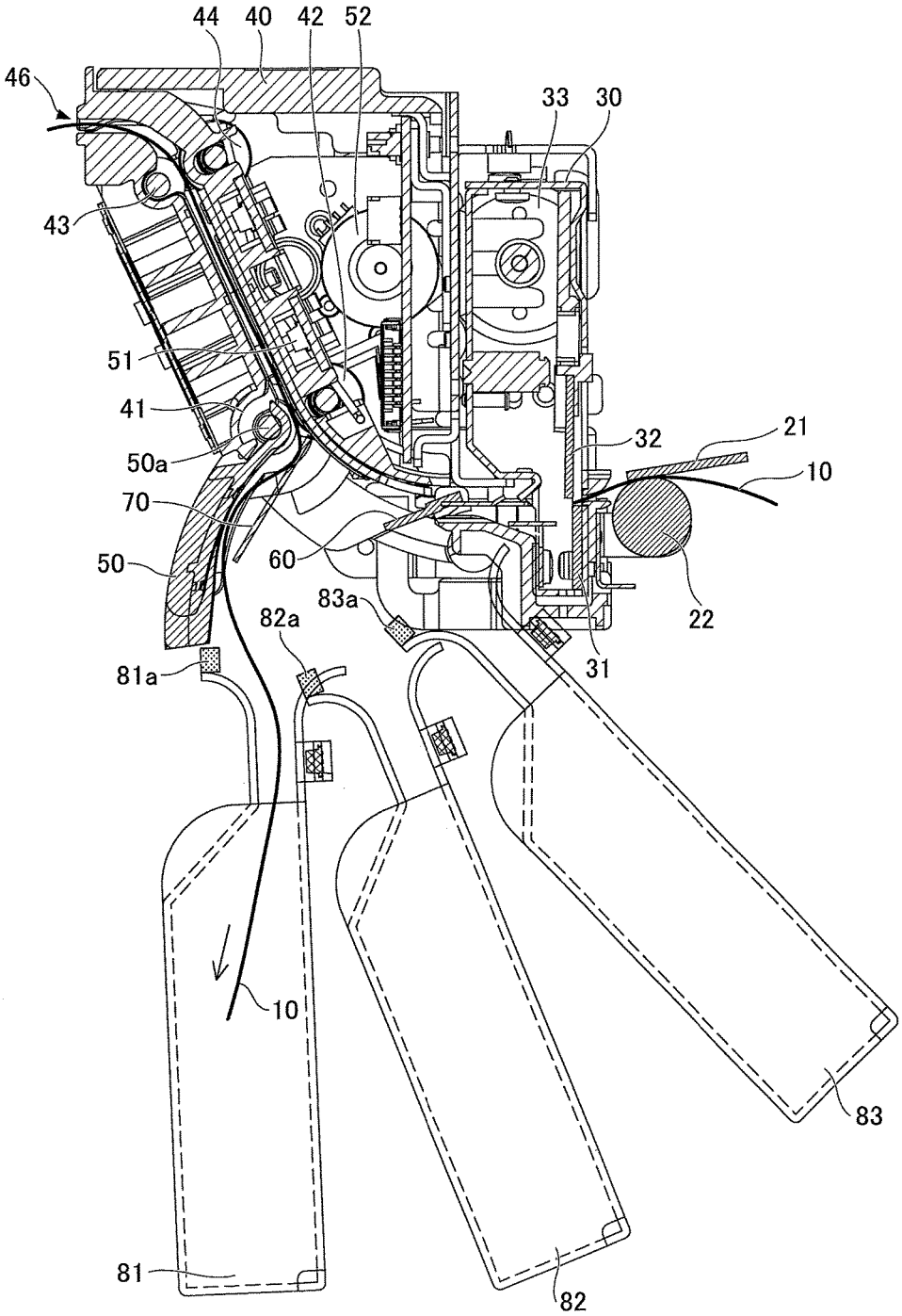
FIG. 11 is a drawing illustrating the collection boxes of the printer apparatus according to the present embodiment.

In the case of the flapper 50 being at the largest open angle, the reverse rotation of the transport motor 45 causes the printed recording paper 10 in the transport path of the presenter unit 40 to be conveyed from the presenter unit 40 to the first collection box 81 through the flapper 50 as illustrated in FIG. 11. In this case, the adjusted angle of the open flapper 50 is such that the recording paper 10 enters the first collection box 81. Because of this, the recording paper 10 is stored in the first collection box 81 upon being conveyed through the path between the flapper 50 and the recording paper guiding member 70. It may be noted that the first collection box 81 or the like has the first collection-position detecting sensor 81*a* for detecting whether the flapper 50 is in the open state that allows the printed recording paper 10 to be conveyed into the first collection box 81.

Figure 12:
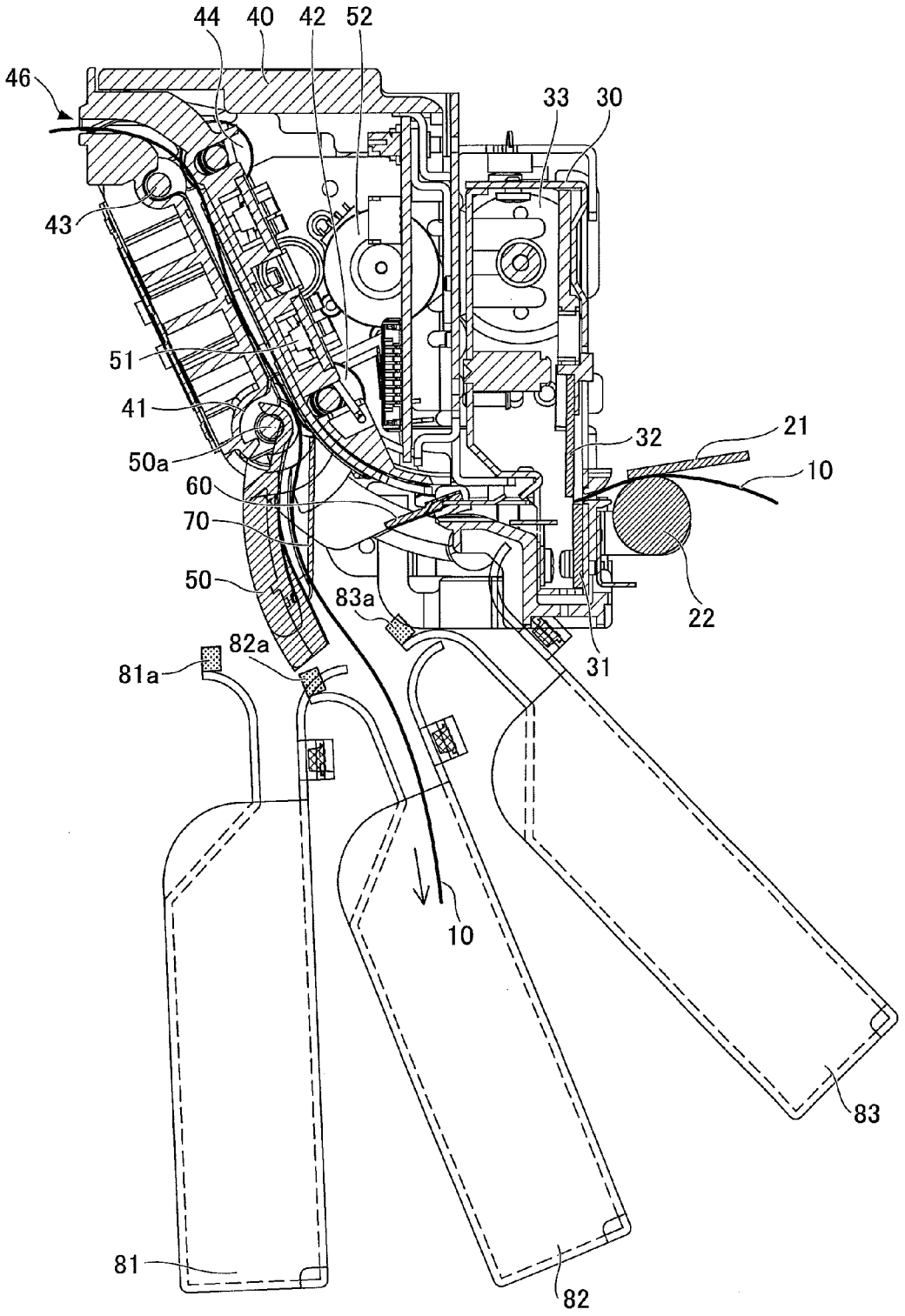
FIG. 12 is a drawing illustrating the collection boxes of the printer apparatus according to the present embodiment.

When the open angle of the flapper 50 is smaller as illustrated in FIG. 12 than in the case of FIG. 11, the reverse rotation of the transport motor 45 causes the printed recording paper 10 to be conveyed from the presenter unit 40 to the second collection box 82 through the flapper 50. In this case, the adjusted angle of the open flapper 50 is such that the printed recording paper 10 enters the second collection box 82. Because of this, the printed recording paper 10 is stored in the second collection box 82 upon being conveyed through the path between the flapper 50 and the recording paper guiding member 70. It may be noted that the second collection box 82 or the like has the second collection-position detecting sensor 82*a* for detecting whether the flapper 50 is in the open state that allows the printed recording paper 10 to be conveyed into the second collection box 82.

Figure 13:
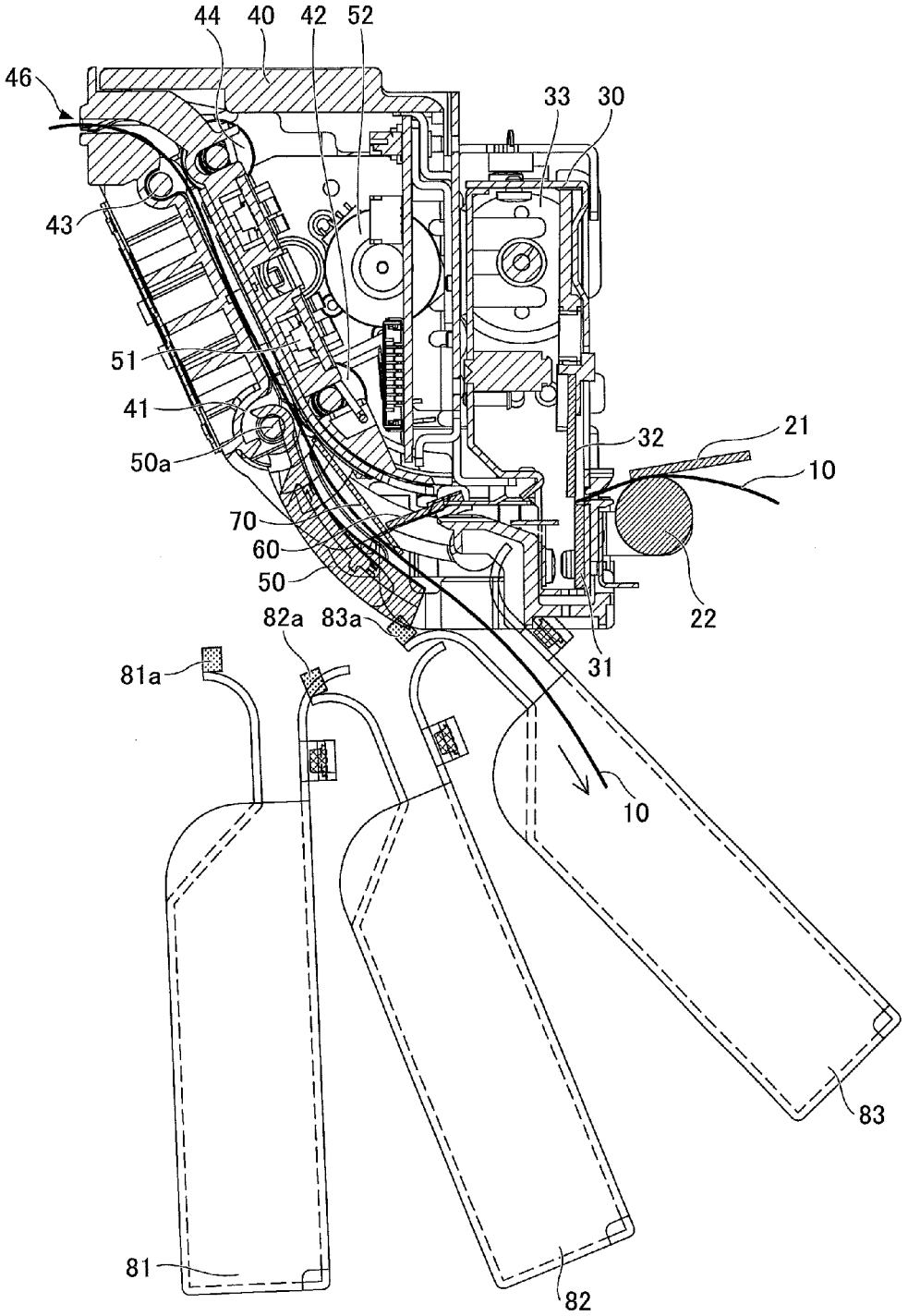
FIG. 13 is a drawing illustrating the collection boxes of the printer apparatus according to the present embodiment.

When the open angle of the flapper 50 is smaller as illustrated in FIG. 13 than in the case of FIG. 12, the reverse rotation of the transport motor 45 causes the printed recording paper 10 to be conveyed from the presenter unit 40 to the third collection box 83 through the flapper 50. In this case, the adjusted angle of the open flapper 50 is such that the printed recording paper 10 enters the third collection box 83. Because of this, the printed recording paper 10 is stored in the third collection box 83 upon being conveyed through the path between the flapper 50 and the recording paper guiding member 70. It may be noted that the third collection box 83 or the like has the third collection-position detecting sensor 83*a* for detecting whether the flapper 50 is in the open state that allows the printed recording paper 10 to be conveyed into the third collection box 83.

In the manner as described above, the printer apparatus of the present embodiment is operable to sort and store the printed recording paper 10 in one of the first collection box 81, the second collection box 82, and the third collection box 83 according to the usage thereof or the like. It may be noted that in the present embodiment, the flapper 50 disposed in the presenter unit 40 is used to sort the recording paper 10, so that the recording paper 10 can be sorted and stored even when the length of the printed recording paper 10 is long.

Figure 14:
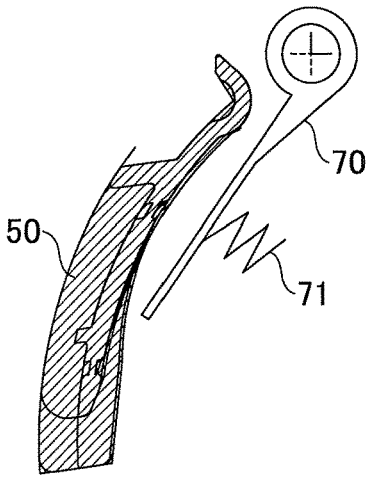
FIG. 14 is a drawing for illustrating a recording paper guiding member.
Figure 15:
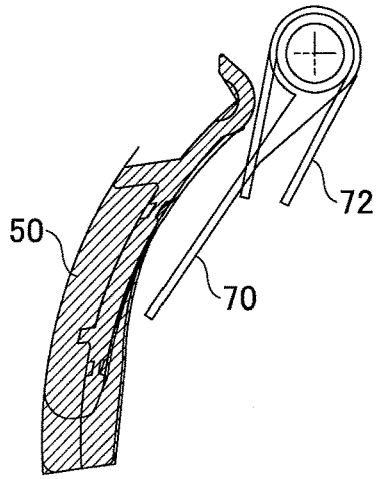
FIG. 15 is a drawing for illustrating the recording paper guiding member.
Figure 16:
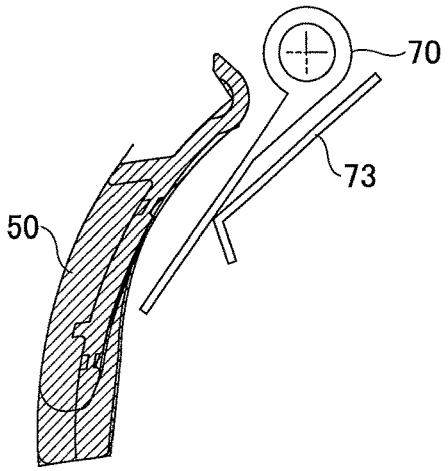
FIG. 16 is a drawing for illustrating the recording paper guiding member.
Figure 17:
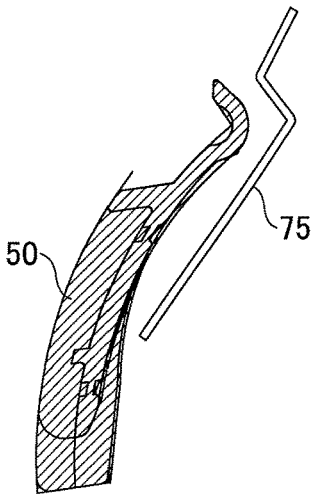
FIG. 17 is a drawing for illustrating a recording paper guiding member.
Figure 18:
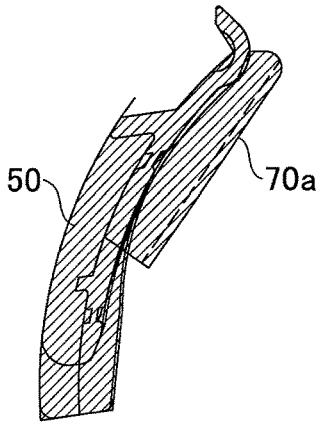
FIG. 18 is a drawing for illustrating a recording paper guide disposed at the flapper.

The recording paper guiding member 70 is pressed by a spring or the like toward the position of the flapper 50 so as to move with the flapper 50 when the flapper 50 flips open. As illustrated in FIG. 14, provision may be made such that the recording paper guiding member 70 is pressed by the restorative force of a coil spring 71 toward to the position of the flapper 50. Alternatively, as illustrated in FIG. 15, provision may be made such that the recording paper guiding member 70 is pressed by the restorative force of a torsion coil spring 72 toward to the position of the flapper 50. Alternatively, as illustrated in FIG. 16, provision may be made such that the recording paper guiding member 70 is pressed by the restorative force of a plate spring 73 toward to the position of the flapper 50. Alternatively, as illustrated in FIG. 17, a recording paper guiding member 75 may be formed of such a material having spring property as metal. Alternatively, as illustrated in FIG. 18, the flapper 50 may be provided with a recording paper guide 70*a* serving as a recording paper guiding member. In the case of FIG. 18, the recording paper 10 is conveyed through a path inside the recording paper guide 70*a* provided as part of the flapper 50, or through the path between the flapper 50 and the recording paper guide 70*a*.

In the following, a description will be given of the transport of the recording paper 10 in the printer apparatus of the present embodiment. It may be noted that the operations of the printer apparatus of the present embodiment (e.g., the transport of the recording paper 10 and the opening and closing movement of the flapper 50) are performed under the control of a control unit 100 (see FIG. 1). In FIGS. 19A and 19B through FIG. 24, the first collection box 81, the second collection box 82, and the third collection box 83 are omitted from illustration for the sake of convenience.

Figure 19A:
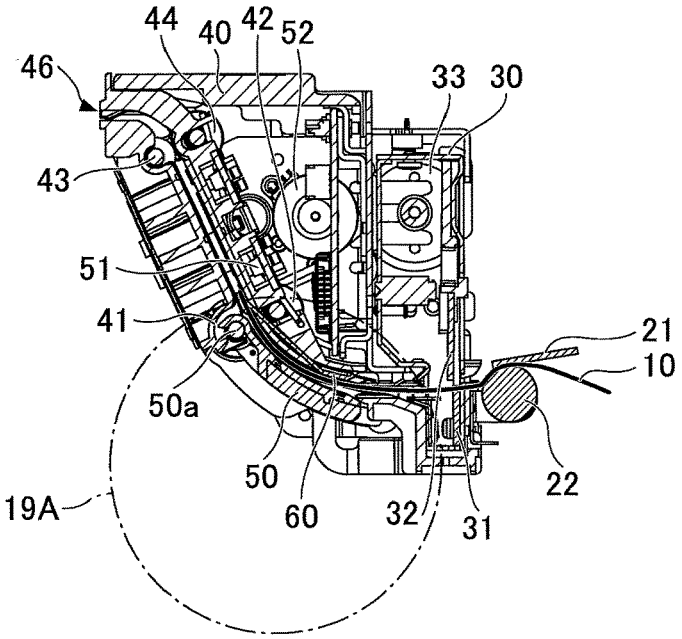
FIG. 19A is a drawing illustrating the opening and closing of the flapper of the printer apparatus according to the present embodiment.
Figure 19B:
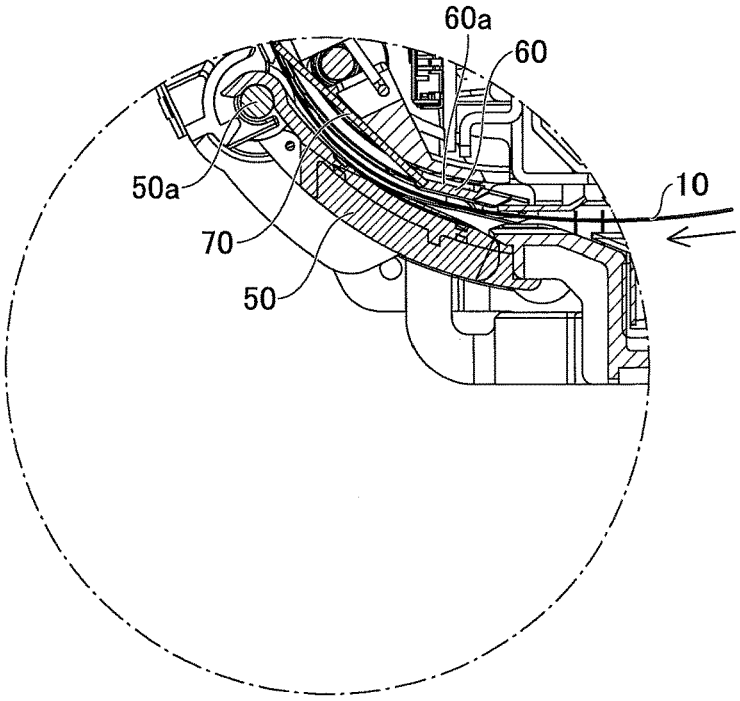
FIG. 19B is a drawing illustrating the opening and closing of the flapper of the printer apparatus according to the present embodiment.

As illustrated in FIGS. 19A and 19B, the recording paper 10 on which the thermal head 21 has printed passes through the cutter unit 30 first, and then enters the transport path situated inside the presenter unit 40. As this happens, the recording paper 10 is conveyed while placed between the first roller 41 and the second roller 42 inside the presenter unit 40. In the state illustrated in FIGS. 19A and 19B, the flapper 50 is in the closed position, so that the recording paper transport guide 60 is also in the closed position. The flapper 50 is situated under the transport path inside the presenter unit 40, and the recording paper transport guide 60 is situated over the transport path of the recording paper 10. The recording paper 10 passes through the gap between the flapper 50 and the recording paper transport guide 60. In the state illustrated in FIGS. 19A and 19B, the recording paper sensor 51 disposed between the first roller 41 and the third roller 43 has not yet detected the recording paper 10, so that the flapper 50 remains to be closed, and the first roller 41 and the second roller 42 are rotating. FIG. 19B is an enlarged view of a portion enclosed by a dotted and dashed line 19A in FIG. 19A.

Figure 20A:
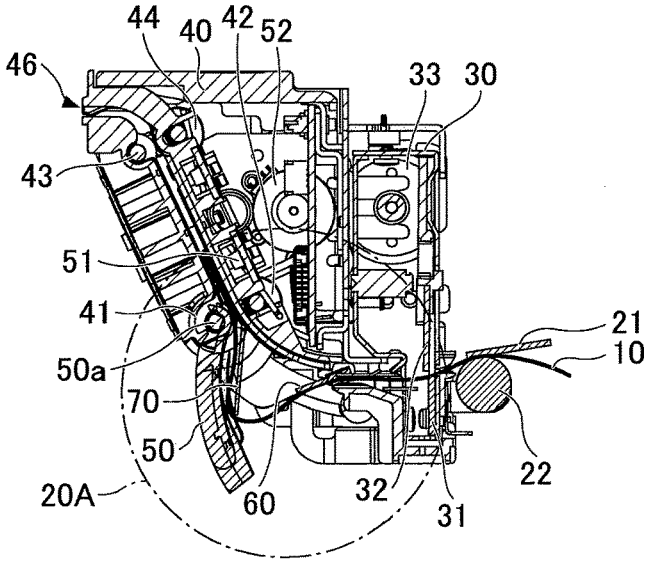
FIG. 20A is a drawing illustrating the opening and closing of the flapper of the printer apparatus according to the present embodiment.
Figure 20B:
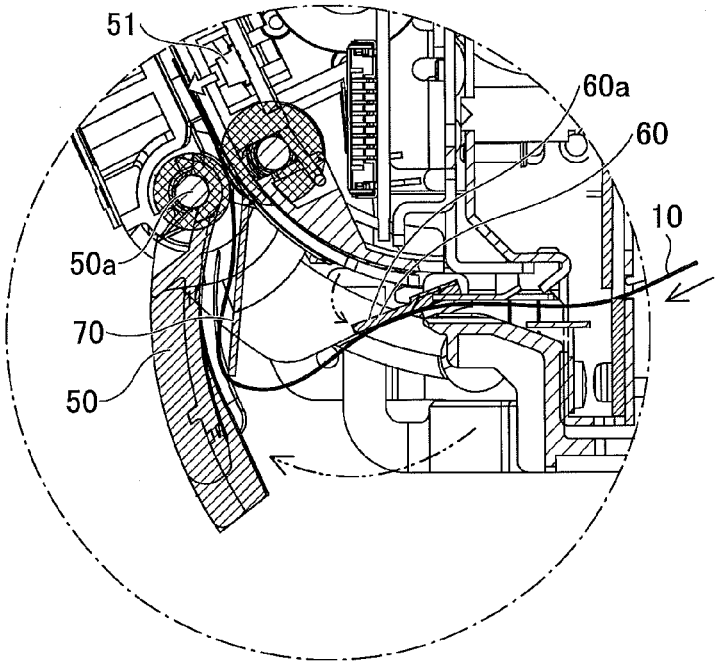
FIG. 20B is a drawing illustrating the opening and closing of the flapper of the printer apparatus according to the present embodiment.

Subsequently, the recording paper 20 is further conveyed by the first roller 41 and the second roller 42 from the state illustrated in FIGS. 19A and 19B to the state as illustrated in FIGS. 20A and 20B, in which the recording paper 10 has advanced to the position at which the recording paper sensor 51 is disposed. The recording paper sensor 51 thus detects the recording paper 10. As the recording paper sensor 51 detects the recording paper 10, the rotation of the first roller 41 is suspended to refrain from conveying the recording paper 10 through the transport path beyond the first roller 41, and, also, the flapper 50 is flipped open. The flapper 50 being flipped open toward the outside of the presenter unit 40 causes the transport path to be exposed to the outside of the presenter unit 40. In the state illustrated in FIGS. 20A and 20B, the head end of the recording paper 10 is placed between and gripped by the first roller 41 and the second roller 42. FIG. 20B is an enlarged view of a portion enclosed by a dotted and dashed line 20A in FIG. 20A.

Figure 21A:
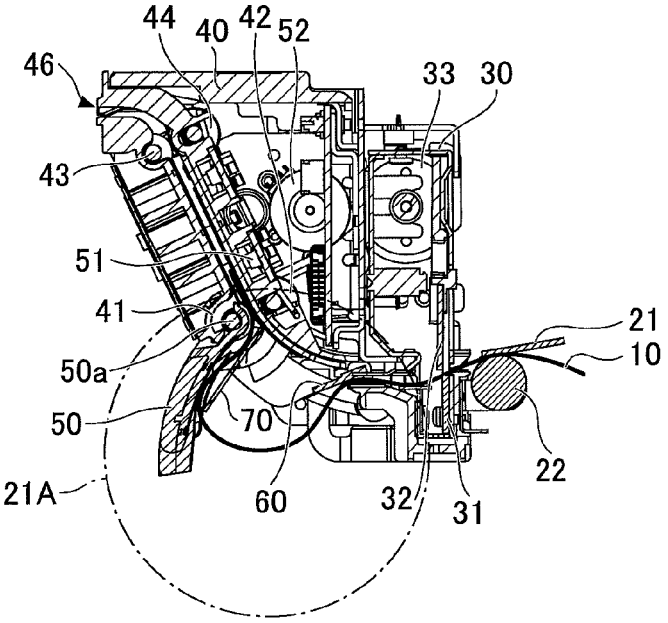
FIG. 21A is a drawing illustrating the opening and closing of the flapper of the printer apparatus according to the present embodiment.
Figure 21B:
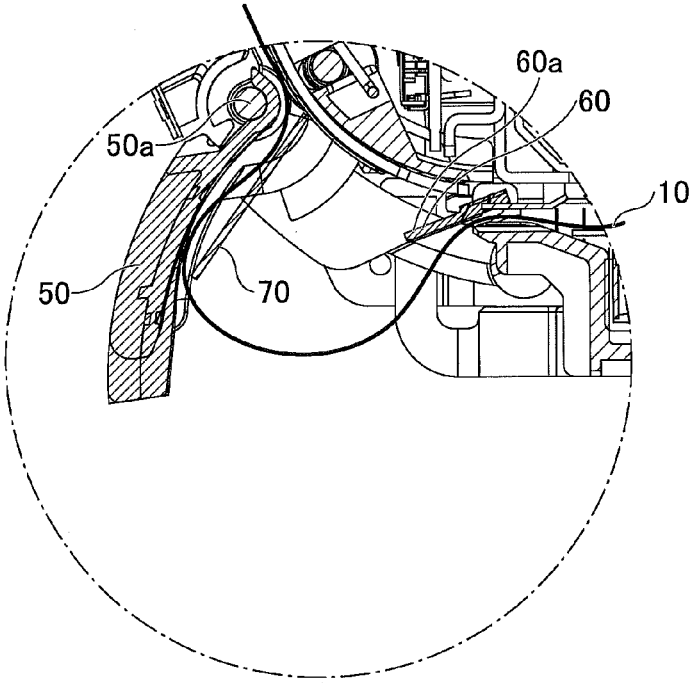
FIG. 21B is a drawing illustrating the opening and closing of the flapper of the printer apparatus according to the present embodiment.

Subsequently, as illustrated in FIGS. 21A and 21B, with the rotation of the second roller 41 being stopped and the flapper 50 being in the open state, the recording paper 10 printed by the thermal head 21 is conveyed further into the presenter unit 40 after passing through the cutter unit 30. Namely, the rotation of the platen roller 22 causes the recording paper 10 to be conveyed toward the presenter unit 40. Since the first roller 41 is not rotating, the recording paper 10 will produce a slack that extends to the outside of the presenter unit 40 through the space provided by the opened flapper 50 as illustrated in FIGS. 21A and 21B. FIG. 21B is an enlarged view of a portion enclosed by a dotted and dashed line 21A in FIG. 21A.

In the present embodiment, the flapper 50 of the presenter unit 40 is flipped open, and, together therewith, the recording paper transport guide 60 is flipped outward, so that the guide unit 60*a* of the recording paper transport guide 60 is directed downward (i.e., moves outwardly to intrude into the transport path). As a result, the downwardly directed guide unit 60*a* guides the recording paper 10 such that the travel direction of the recording paper 10 is directed to the outside of the presenter unit 40. This creates a desired slack in the recording paper 10 without causing the recording paper 10 to be folded despite the presence of strong curl in the recording paper 10.

Figure 22A:
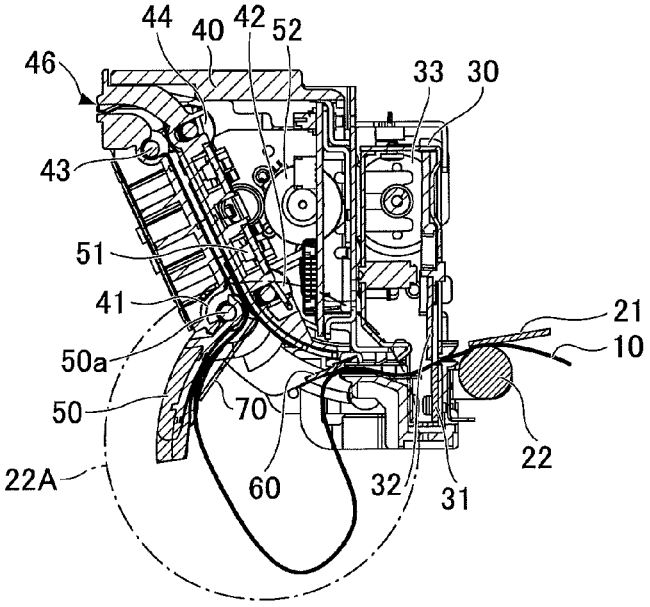
FIG. 22A is a drawing illustrating the opening and closing of the flapper of the printer apparatus according to the present embodiment.
Figure 22B:
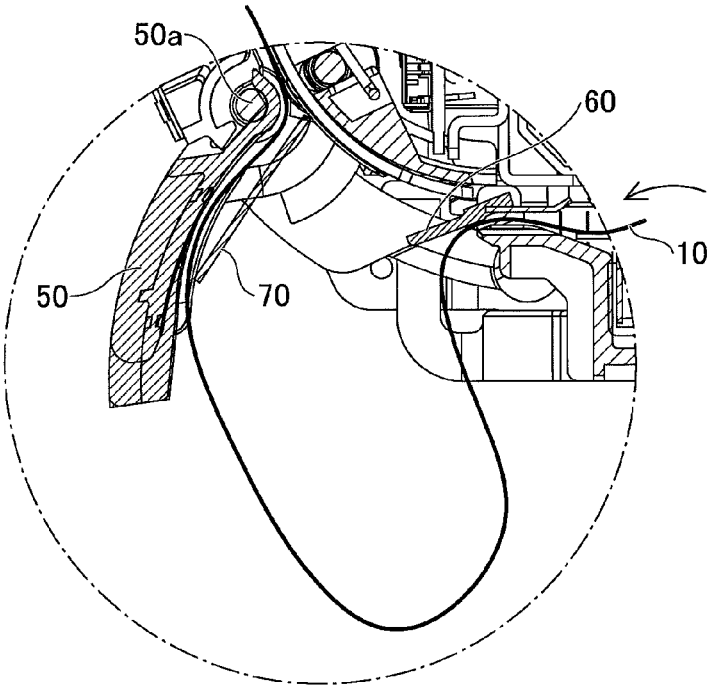
FIG. 22B is a drawing illustrating the opening and closing of the flapper of the printer apparatus according to the present embodiment.

Subsequently, with the rotation of the first roller 41 being in the suspended state and the flapper 50 being in the open state, the recording paper 10 printed by the thermal head 21 is advanced further from the state illustrated in FIGS. 21A and 21B into the presenter unit 40 as illustrated in FIGS. 22A and 22B after passing through the cutter unit 30. Namely, the rotation of the platen roller 22 causes the printed recording paper 10 to be further conveyed toward the presenter unit 40. In this state, the first roller 41 is not rotating, and the flapper 50 is open, so that the recording paper 10 printed by the thermal head 21 travels toward the outside of the presenter unit 40 due the open-position flapper 50 after passing through the inside of the cutter unit 30. As a result, the slack of the recording paper 10 extending to the outside of the presenter unit 40 grows. FIG. 22B is an enlarged view of a portion enclosed by a dotted and dashed line 22A in FIG. 22A.

Figure 23A:
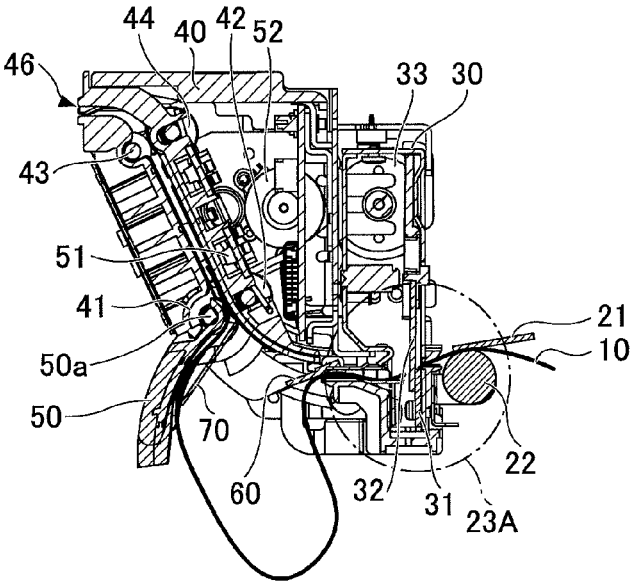
FIG. 23A is a drawing illustrating the opening and closing of the flapper of the printer apparatus according to the present embodiment.
Figure 23B:
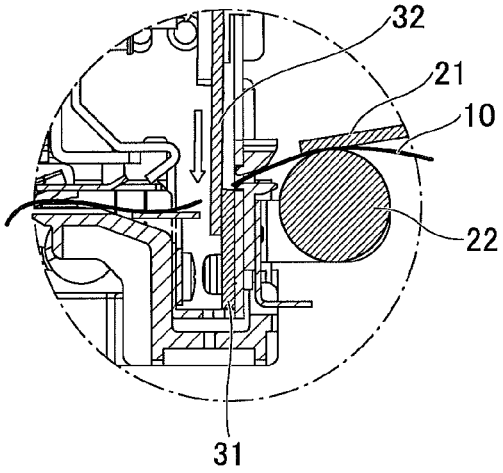
FIG. 23B is a drawing illustrating the opening and closing of the flapper of the printer apparatus according to the present embodiment.

Subsequently, as illustrated in FIGS. 23A and 23B, the cutter unit 30 uses the fixed blade 31 and the movable blade 32 to cut a desired length of the printed recording paper 10. A portion of the printed recording paper 10 extends to the outside of the presenter unit 40 through the space provided by the open flapper 50, which makes it possible for a desired length of the recording paper 10 to be cut even when such a desired length of the recording paper 10 is longer than the length of the transport path. FIG. 23B is an enlarged view of a portion enclosed by a dotted and dashed line 23A in FIG. 23A.

Figure 24:
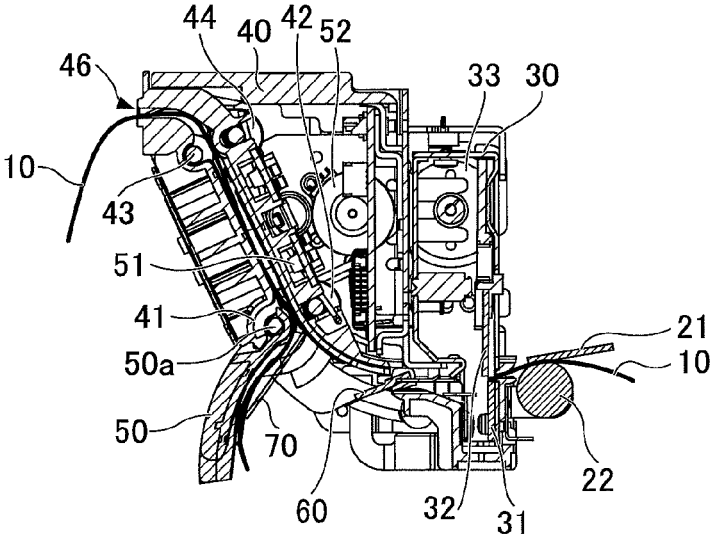
FIG. 24 is a drawing illustrating the opening and closing of the flapper of the printer apparatus according to the present embodiment.

Subsequently, as illustrated in FIG. 24, the first roller 41 and the third roller 43 are rotated to advance the printed recording paper 10 a predetermined distance toward the discharge slot 46. As this happens, a portion of the recording paper 10 is situated in the transport path between the flapper 50 and the recording paper guiding member 70. In this state, the head end of the printed recording paper 10 is exposed from the discharge slot 46 to allow a user to remove the recording paper. The tail end of the recording paper 10 is exposed to the outside from the open flapper 50.

Figure 25:
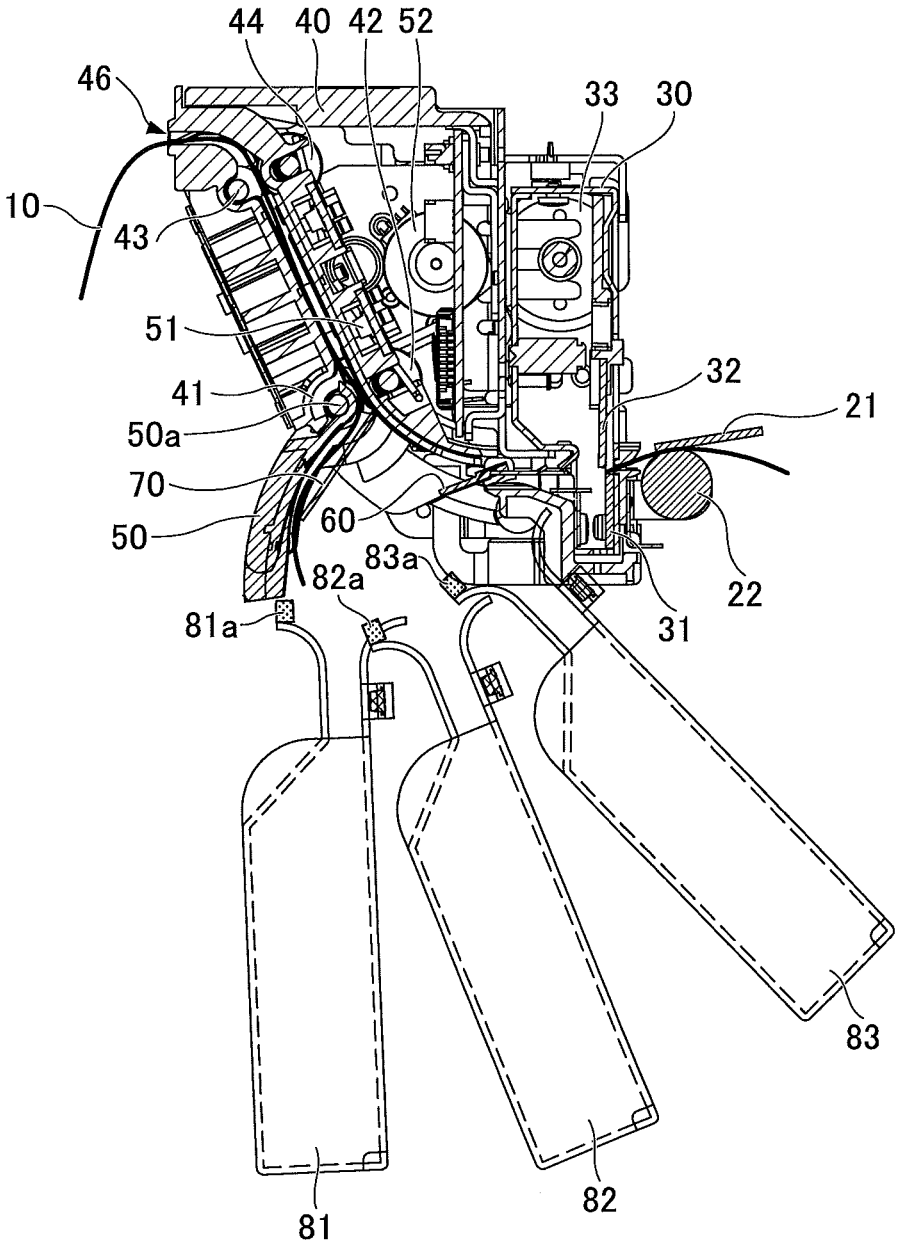
FIG. 25 is a drawing illustrating the opening and closing of the flapper of the printer apparatus according to the present embodiment.

Subsequently, the flapper 50 is flipped open at a proper angle as illustrated in FIG. 25, such that the printed recording paper 10 can enter a desired collection box among the first collection box 81, the second collection box 82, and the third collection box 83. Specifically, the flapper drive motor 52 is rotated to flip open the flapper 50, so that the angle of the flapper 50 is adjusted such as to enable collection in a desired collection box among the first collection box 81, the second collection box 82, and the third collection box 83. FIG. 25 illustrates the case in which the open state of the flapper 50 allows the printed recording paper 10 to enter the first collection box 81. In this state, the tail end of the recording paper 10 situated alongside the flapper 50 is pointed at the opening (i.e., collection slot) of the first collection box 81.

Figure 26A:
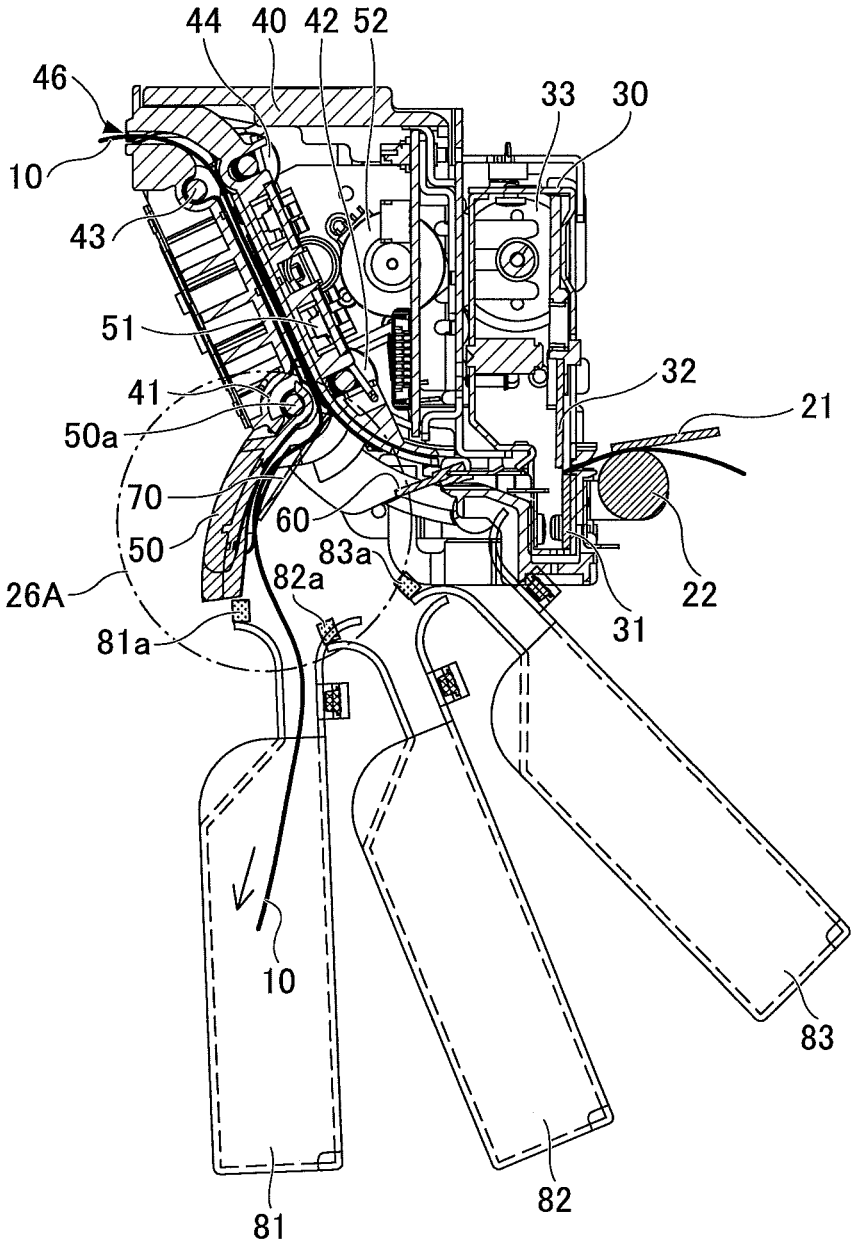
FIG. 26A is a drawing illustrating the opening and closing of the flapper of the printer apparatus according to the present embodiment.
Figure 26B:
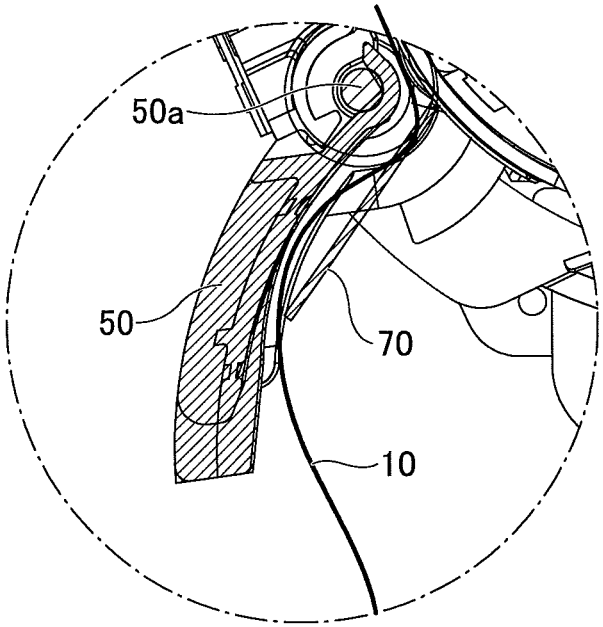
FIG. 26B is a drawing illustrating the opening and closing of the flapper of the printer apparatus according to the present embodiment.

As illustrated in FIGS. 26A and 26B, then, the recording paper 10 is advanced into the desired collection box. Specifically, the reverse rotation of the transport motor 45 causes the first roller 41 and the third roller 43 to be rotated in the reverse direction to convey the recording paper 10 in the reverse direction through the transport path. Consequently, the recording paper 10 having been conveyed in the reverse direction through the transport path inside the presenter unit 40 enters one of the first collection box 81, the second collection box 82, and the third collection box 83 through the space provided by the open flapper 50. In the state illustrated in FIG. 26, the open flapper 50 is at such an angle as to put the recording paper 10 in the first collection box 81. The recording paper 10 passes through the gap between the flapper 50 and the recording paper guiding member 70 to be conveyed and stored in the first collection box 81. FIG. 26B is an enlarged view of a portion enclosed by a dotted and dashed line 26A in FIG. 26A.

In order to sort and store the printed recording paper 10 in a desired collection box, the printer apparatus of the present embodiment may be first placed in the state illustrated in FIG. 25, and may then make a transition to the state illustrated in FIGS. 26A and 26B. Alternatively, collection may be performed as illustrated in FIGS. 26A and 26B in response to the situation in which the printed recording paper 10 is not removed by a user after the state illustrated in FIG. 25.

Subsequently, the flapper drive motor 52 is rotated in the reverse direction to close the flapper 50. In conjunction with this, the recording paper transport guide 60 is also closed to return to the state illustrated in FIGS. 19A and 19B. Reverse rotation of the flapper drive motor 52 at this instant is performed after the recording paper sensor 51 or the like confirms the nonexistence of the recording paper 10 in the transport path, i.e., confirms the discharge of the recording paper 10 from the transport path.

When next printing is thereafter performed on the recording paper 10, the same or similar operations as described heretofore will be performed.

Further, although a description has been given with respect to one or more embodiments of the present invention, the contents of such a description do not limit the scope of the invention.

The present application claims foreign priority to Japanese priority application No. 2014-167894 filed on Aug. 20, 2014, with the Japanese Patent Office, the entire contents of which are hereby incorporated by reference.

DESCRIPTION OF REFERENCE SYMBOLS

10 recording paper
20 printer main body
21 thermal head
22 platen roller
23 conveyance motor
30 cutter unit
31 fixed blade
32 movable blade
33 movable-blade motor
40 presenter unit
41 first roller
42 second roller
43 third roller
44 fourth roller
45 transport motor
46 discharge slot
50 flapper
50*a* rotation axis
51 recording paper sensor
52 flapper drive motor
52*a* gear
53 first gear
54 second gear
55 third gear
56 fourth gear
60 recording paper transport guide
60*a* guide unit
60*b* rotation axis
61 mounting member
70 recording paper guiding member
81 first collection box
81*a* first collection-position detecting sensor
82 second collection box
82*a* second collection-position detecting sensor
83 third collection box
83*a* third collection-position detecting sensor

The invention claimed is:

1. A printer apparatus, comprising:

a printer main body having a platen roller and a print head to print on recording paper;

a cutter unit configured to cut the recording paper; and a presenter unit connected to the cutter unit, wherein the recording paper on which the print head has printed enters the presenter unit through the cutter unit, and comes out from a discharge slot of the presenter unit, wherein the presenter unit includes:

a first roller and a second roller configured to convey the recording paper placed therebetween; and a flapper disposed along a transportation path of the recording paper between the cutter unit and both the first roller and the second roller, and configured to be flipped open to an outside of the presenter unit to expose the transportation path, wherein an angle at which the flapper is open is selectively set to one of a plurality of different angles, wherein the plurality of different angles include at least a first angle and a second angle different from the first angle, and the flapper is configured to be opened at the first angle for the recording paper for a first sorting location and to be opened at the second angle for the recording paper for a second sorting location.

2. The printer apparatus as claimed in claim 1, further comprising a plurality of collection boxes configured to store the recording paper discharged from the flapper, wherein the flapper is opened such that an open angle thereof corresponds to one collection box among the plurality of collection boxes.

3. The printer apparatus as claimed in claim 2, wherein the presenter unit further includes a recording paper guiding member configured to move in conjunction with the flapper, and wherein the printed recording paper passes through a gap between the flapper and the recording paper guiding member when the flapper is open, and is conveyed to one collection box among the plurality of collection boxes.

4. The printer apparatus as claimed in claim 2, wherein each of the plurality of collection boxes has a collection-position detecting sensor configured to detect a position of the flapper.

5. The printer apparatus as claimed in claim 1, wherein the presenter unit includes a flapper drive motor configured to open and close the flapper.

6. A printer apparatus, comprising:

a cutter configured to cut printed recording paper;

a discharge slot configured to discharge the printed recording paper;

a roller disposed between the discharge slot and the cutter to convey the printed recording paper;

a flapper disposed between the roller and the cutter along a transport path of the printed recording paper, and configured to flip open to expose the transport path; and a control unit configured to open the flapper while adjusting an angle of the opened flapper, wherein the control unit is configured to open the flapper at a first angle for the printed recording paper for a first sorting location and to open the flapper at a second angle for the printed recording paper for a second sorting location, the second angle being different from the first angle.

7. The printer apparatus as claimed in claim 6, wherein the roller rotates in a first direction to convey the printed recording paper toward the discharge slot in a state in which the flapper is closed to cover the transport path, and the roller rotates in a second direction opposite the first direction in a state in which the flapper is open to expose the transport path, thereby to discharge the printed recording paper through an exposed portion of the transport path.

* * * * *